US011199025B2

(12) United States Patent
Lai

(10) Patent No.: US 11,199,025 B2
(45) Date of Patent: Dec. 14, 2021

(54) COMBINATION PADLOCK WITH ANTI-PICKING AND DECODE MECHANISM

(71) Applicant: The Sun Lock Company Limited, Tuen Mun (HK)

(72) Inventor: Karl Lai, Tai Po (HK)

(73) Assignee: The Sun Lock Company Limited, Hong Kong (HK)

( * ) Notice: Subject to any disclaimer, the term of this patent is extended or adjusted under 35 U.S.C. 154(b) by 197 days.

(21) Appl. No.: 16/688,405

(22) Filed: Nov. 19, 2019

(65) Prior Publication Data

US 2020/0190855 A1 Jun. 18, 2020

Related U.S. Application Data

(60) Provisional application No. 62/781,119, filed on Dec. 18, 2018.

(51) Int. Cl.

| | |
|---|---|
| ***E05B 37/02*** | (2006.01) |
| ***E05B 67/24*** | (2006.01) |
| ***E05B 35/10*** | (2006.01) |
| ***E05B 37/00*** | (2006.01) |
| ***E05B 67/00*** | (2006.01) |

(52) U.S. Cl.

CPC ..... *E05B 37/0034* (2013.01); *E05B 35/105* (2013.01); *E05B 37/002* (2013.01); *E05B 37/0058* (2013.01); *E05B 37/025* (2013.01); *E05B 67/003* (2013.01); *E05B 67/24* (2013.01)

(58) Field of Classification Search

CPC ..... E05B 17/145; E05B 35/10; E05B 35/105; E05B 37/002; E05B 37/0031; E05B 37/0034; E05B 37/0048; E05B 37/0058; E05B 37/02; E05B 37/025; E05B 67/003; E05B 67/22; E05B 67/24

See application file for complete search history.

(56) References Cited

U.S. PATENT DOCUMENTS

| | | | |
|---|---|---|---|
| 5,175,709 | A | 12/1992 | Slayton et al. |
| 6,029,481 | A | 2/2000 | Lai |
| 6,035,672 | A | 3/2000 | Lai |
| 6,164,096 | A | 12/2000 | Lai |
| D439,824 | S | 4/2001 | Lai |

(Continued)

FOREIGN PATENT DOCUMENTS

| | | | |
|---|---|---|---|
| CN | 201068678 | Y | 6/2008 |
| CN | 206468121 | U | 9/2017 |
| EP | 1529907 | B1 | 12/2012 |

OTHER PUBLICATIONS

PCT International Search Report and Written Opinion dated Mar. 19, 2020 from corresponding Application No. PCT/CN2019/125914, 7 pages.

*Primary Examiner* — Christopher J Boswell

(74) *Attorney, Agent, or Firm* — Ware, Fressola, Maguire & Barber LLP

(57) ABSTRACT

A padlock comprising a body/housing which contains a fin-catcher and a plate-hole to receive the coupling-plate, a shackle which contains a short-leg and long-leg, so that the short-leg can move away from the locking-hole to control the locking and opening position, a plurality of clutches to prevent the lock from being opened when the dials are not in a lock open by combination code, and a plurality of dials to control the rotational movement of the clutches.

14 Claims, 16 Drawing Sheets

(56) References Cited

U.S. PATENT DOCUMENTS

| | | | | |
|---|---|---|---|---|
| D439,825 | S | 4/2001 | Lai | |
| 6,408,660 | B1 | 6/2002 | Lai | |
| 6,474,116 | B1 | 11/2002 | Lai | |
| D472,790 | S | 4/2003 | Lai | |
| 6,675,614 | B2 | 1/2004 | Lai | |
| 6,729,166 | B1 | 5/2004 | Lai | |
| 6,742,366 | B1 | 6/2004 | Lai | |
| D498,132 | S | 11/2004 | Lai | |
| 6,883,355 | B2 | 4/2005 | Lai | |
| D511,673 | S | 11/2005 | Lai | |
| 7,114,356 | B1 * | 10/2006 | Yu | E05B 37/0034 70/21 |
| 7,140,209 | B2 | 11/2006 | Lai | |
| 7,225,648 | B2 | 6/2007 | Lai | |
| 7,467,531 | B2 | 12/2008 | Lai et al. | |
| 7,562,545 | B2 | 7/2009 | Lai et al. | |
| 7,628,045 | B2 * | 12/2009 | Yu | E05B 37/025 70/21 |
| 7,685,851 | B2 | 3/2010 | Lai | |
| 7,765,840 | B2 | 8/2010 | Lai et al. | |
| 8,056,376 | B2 * | 11/2011 | Yu | E05B 37/025 70/21 |
| 8,096,150 | B2 | 1/2012 | Lai et al. | |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 | 7/2014 | Lai | |
| 8,826,703 | B2 | 9/2014 | Lai | |
| 8,919,155 | B2 | 12/2014 | Lai | |
| 8,931,313 | B2 | 1/2015 | Lai | |
| 9,206,625 | B2 | 12/2015 | Lai | |
| 9,228,373 | B2 * | 1/2016 | Huang | E05B 37/025 |
| 9,228,376 | B2 | 1/2016 | Lai | |
| 9,441,399 | B2 * | 9/2016 | Yu | E05B 37/0031 |
| 9,464,460 | B2 | 10/2016 | Lai | |
| 9,487,969 | B2 | 11/2016 | Lai | |
| 9,556,560 | B2 | 1/2017 | Lai | |
| 9,663,970 | B1 * | 5/2017 | Yang | E05B 35/105 |
| D789,174 | S | 6/2017 | Lai | |
| 9,803,398 | B2 | 10/2017 | Lai | |
| 9,890,559 | B2 | 2/2018 | Lai | |
| 10,047,541 | B2 | 8/2018 | Lai | |
| 10,221,591 | B2 | 3/2019 | Lai | |
| D864,695 | S | 10/2019 | Lai | |
| 10,443,272 | B2 | 10/2019 | Lai | |
| 2005/0092036 | A1 * | 5/2005 | Lai | E05B 35/105 70/25 |
| 2006/0107708 | A1 | 5/2006 | Yu | |
| 2008/0120999 | A1 * | 5/2008 | Lee | E05B 37/0034 70/21 |
| 2008/0307834 | A1 * | 12/2008 | Ma | E05B 37/0034 70/25 |
| 2009/0031764 | A1 * | 2/2009 | Huang | E05B 37/0034 70/21 |
| 2014/0338407 | A1 * | 11/2014 | Zhang | E05B 37/0068 70/21 |
| 2014/0352370 | A1 | 12/2014 | Huang | |

* cited by examiner 13B-13B 14B-14B

COMBINATION PADLOCK WITH ANTI-PICKING AND DECODE MECHANISM

TECHNICAL FIELD

The technical field of the present invention relates to combination padlocks.

BACKGROUND OF THE INVENTION

The present invention is a combination padlock with an advanced anti-picking mechanism which is enclosed in a locking body/housing. Prior art U.S. Pat. No. 5,715,709 has faulty gates, but the effectiveness is limited from a production perspective since there is only one true gate with four faulty gates, which is quite easy for a lock picker to pick.

SUMMARY OF THE INVENTION

An embodiment of the present invention is a padlock that incorporates an improved fault gate mechanism. One such embodiment has nine faulty gates and one true gate. This invention makes the combination mechanism more difficult to pick. The new padlock also has a key mechanism to override the combination mechanism, like many TSA luggage locks. Such locks allow TSA agents to open the lock with an overriding key mechanism. The padlock according to the present invention incorporates another feature; namely, a coupling plate, where one side is an anti-picking mechanism and the reverse side of the coupling plate has a decode function. This means that the key mechanism user can open the lock via key mechanism and also be able to decode the combination code via further explanation below.

Thus, the present invention relates to a padlock comprising a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening arranged for receipt of a short-leg of the shackle in a top side of the body, a plurality of coupling plates, each comprising a fin-protrusion, an opening slot and a plurality of faulty notches, a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body, a plurality of dials, each dial having a plurality of indicia for forming an indicia sequence, each dial placed within one of a plurality of dial slots formed adjacent said plate holes, and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, and wherein the fin of each of the clutches is arranged to contact either the faulty notches or the opening slot when said clutch is caused to rotate together with the associated dial.

Another embodiment of the present invention is the padlock as described above, wherein each dial has N indicia and each coupling plate has N−1 faulty notches, with N being an integer greater than one.

A further embodiment of the present invention is the padlock as described above, wherein each of the plurality of clutches is associated with one of the plurality of coupling plates, and when the padlock is in the unlock by combination mode, the fin of each of the plurality of clutches is aligned with the opening slot in the associated coupling plate, allowing the longitudinal movement of the long-leg together with the plurality of clutches.

A further embodiment of the present invention is the padlock as described above, wherein when the padlock is in the unlock by combination mode, the fin of each of the plurality of clutches is caused to move into the opening slot of the associated connecting plate by the longitudinal movement of the long-leg, so that the dials cannot turn and thereby preventing accidental change of the lock-open combination code.

A further embodiment of the present invention is the padlock as described above, comprising a top ring positioned in a top of the first longitudinal bore so as to prevent an uppermost coupling plate of said plurality of coupling plates from rotating relative to the first longitudinal bore.

A further embodiment of the present invention is the padlock as described above, wherein the top ring includes a direction-fin that engages one of the fin-catchers.

A further embodiment of the present invention is the padlock as described above, wherein when the padlock is in the unlock by combination mode, the shackle can be rotated 180 degrees away from the locking-hole to allow the long-leg of the shackle to be moved downward relative to the top ring so that the fin of each clutch disengages from the teeth of the corresponding dial, thereby allowing turning of the dials to enter a new lock-open combination code constituting a reset mode.

A further embodiment of the present invention is the padlock as described above, having an unlock by key mode, said padlock further comprising a blocking-plate that controls movement of a moveable blocking-edge, and wherein the key mechanism is configured to control said blocking-edge so as to move said blocking-edge away from the opening in the fixed-cam so as to allow rotation of the short shackle away from the locking-hole when a correct key is inserted and rotated in said key mechanism.

A further embodiment of the present invention is the padlock as described above, wherein the key mechanism includes a cylinder with a cylinder housing, and wherein the fixed-cam comprises a slot to receive an extended-tip of the cylinder housing, wherein the fixed-cam is permanently affixed to the body so as to prevent the fixed-cam and cylinder housing from rotational or longitudinal movement relative to the body when the padlock is not in the unlock by key mode.

A further embodiment of the present invention is the padlock as described above, wherein the blocking-plate comprises a pin, and the cylinder is configured to receive the correct key for rotating the cylinder in said key mechanism, the padlock further comprising a rotating cam engaged with the cylinder for rotation together, the rotating cam comprising a sloping slot slidably engaged with the pin of the blocking-plate, wherein when the cylinder is rotated, the blocking edge of the blocking-plate is caused to move away from the opening of the blocking hole on the fixed cam.

A further embodiment of the present invention is the padlock as described above, comprising a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening arranged for receipt of a short-leg of the shackle in a top side of the body, a plurality of coupling plates, each comprising a fin-protrusion and an opening slot, a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body, a plurality of dials, each dial having a plurality of indicia for forming an indicia sequence, each dial placed within one of a plurality of dial slots formed adjacent said plate holes, and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, and each of the coupling plates further comprises a decode edge and a decode wall formed thereon, the decode wall having a first wall side adjacent to the opening slot and a second wall side having a wall slope, said padlock having an unlock by key mode to allow the short-leg of the shackle to rotate 180 degrees relative to the locking-hole so as to allow the long-leg of the shackle to move downward relative to the top side of the body together with the clutches such that the fin of at least some of the clutches is in contact to the decode edge of an adjacent one of the coupling plates, and wherein when the rotational movement of each clutch is made in a first movement direction, the rotational movement in the first movement direction is caused to stop when the fin of said clutch contacts the first wall side of the decode wall as the fin aligns with the adjacent opening slot, thereby allowing the lock-open combination code to be read, and when the rotational movement of each clutch is made in a direction opposite to the first movement direction, said long-leg of the shackle is caused to move upward relative to the top side of the body when the fin of said clutch is caused to move upward by the wall slope, preventing the fin of said clutch from aligning with the adjacent opening slot.

A further embodiment of the present invention is the padlock as described above, wherein each coupling plate further comprises a plurality of faulty notches, and the fin of each of the clutches is arranged to contact either the faulty notches or the opening slot when said clutch is caused to rotate together with the associated dial when the indicia sequence of the dials is different from a lock-open combination code, and wherein each of the decode edge comprises a first edge side for forming the faulty notches and an opposing second side for forming the decode wall having the wall slope.

A still further aspect of the present invention is a method of decoding a lock-open combination code in a padlock, the padlock comprising a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening for receipt of a short-leg of the shackle in a top side of the body, a plurality of coupling plates, each comprising a fin-protrusion and an opening slot, a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body, a plurality of dials, each dial having a plurality of indicia for forming an indicia sequence, each dial placed within one of a plurality of dial slots formed adjacent said plate holes, and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, said method comprising providing on each of the coupling plates a decode edge and a decode wall formed thereon, the decode wall having a first wall side adjacent to the opening slot and a second wall side having a wall slope, said padlock having an unlock by key mode to allow the short leg of the shackle to rotate 180 degrees relative to the locking hole so as to allow the long leg of the shackle to move downward relative to the top side of the body together with the clutches such that the fin of at least some of the clutches is arranged to contact the decode edge of an adjacent one of the coupling plates, and wherein when the rotational movement of each clutch is made in a first movement direction, the rotational movement in the first movement direction is caused to stop when the fin of said clutch contacts the first wall side of the decode wall as the fin aligns with the adjacent opening slot, thereby allowing the lock-open combination code to be read, and when the rotational movement of each clutch is made in a direction opposite to the first movement direction, said long leg of the shackle is caused to move upward relative to the top side of the body when the fin of said clutch is caused to move upward by the wall slope, preventing the fin of said clutch from aligning with the adjacent opening slot.

BRIEF DESCRIPTION OF THE DRAWINGS (FIGS. 1A-23)

For a fuller understanding of the present invention, reference is made to the following detailed description taken in conjunction with the following drawings in which.

DETAILED DESCRIPTION (FIGS. 1A-23)

Figure 1A:
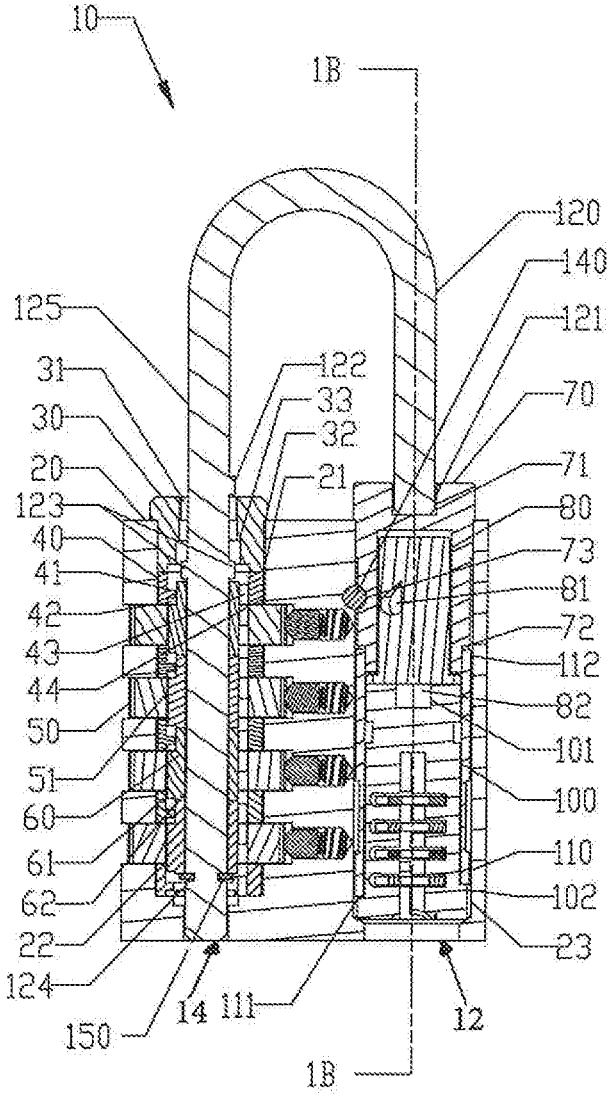
FIG. 1A is a cross-sectional view of an embodiment of a padlock according to the present invention.
Figure 1B:
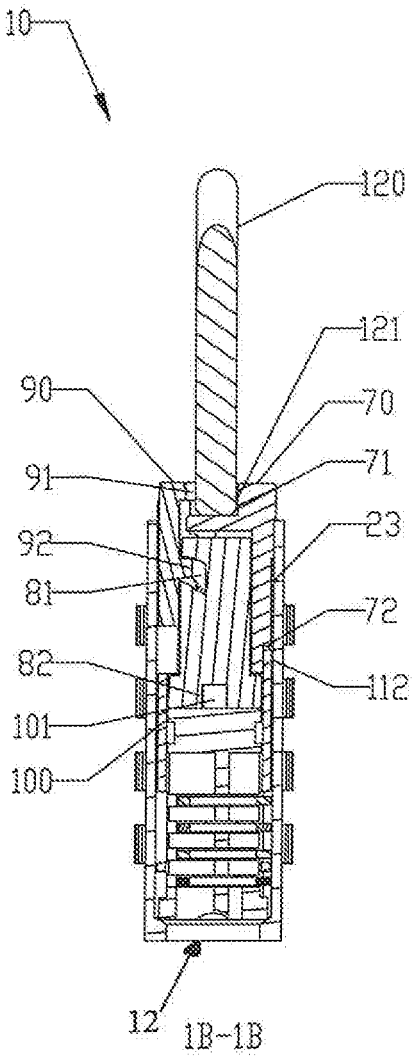
FIG. 1B is a cross-sectional view of the padlock shown in FIG. 1A taken along line 1B-1B of FIG. 1A.
Figure 2:
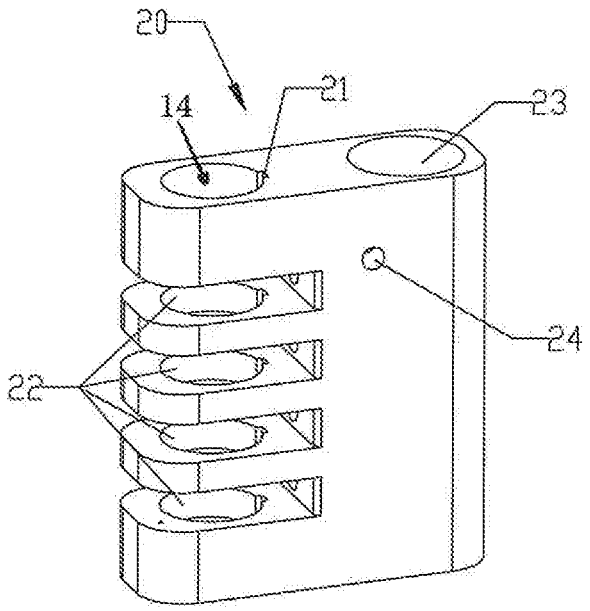
FIG. 2 is a perspective view of the body of the padlock shown in FIGS. 1A and 1B.
Figure 3A:
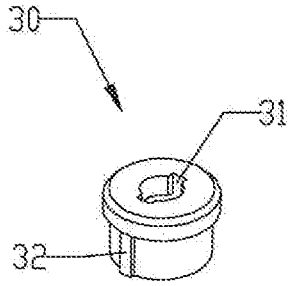
FIG. 3A is a top perspective view of a top ring forming part of the padlock.
Figure 3B:
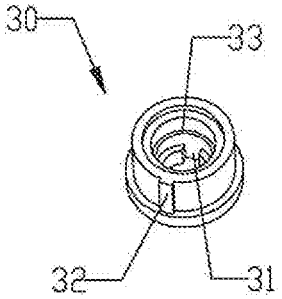
FIG. 3B is a bottom perspective view of the top ring.
Figure 4A:
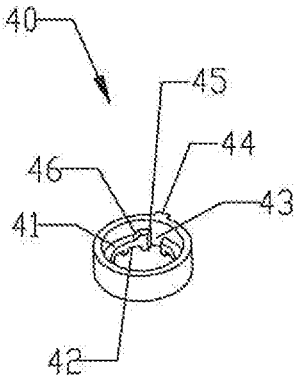
FIG. 4A is a top perspective view of a coupling plate forming part of the padlock.
Figure 4B:
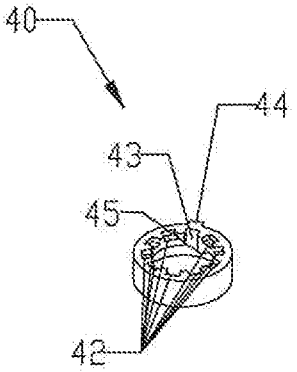
FIG. 4B is a bottom perspective view of the coupling-plate.
Figure 5:
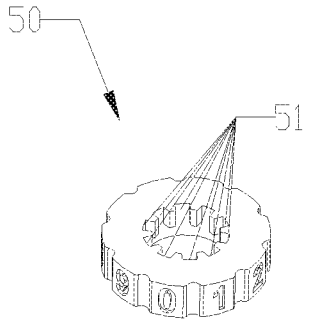
FIG. 5 is a perspective view of a dial forming part of the padlock.
Figure 6:
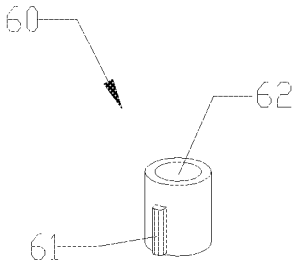
FIG. 6 is a perspective view of a clutch forming part of the padlock.
Figure 7:
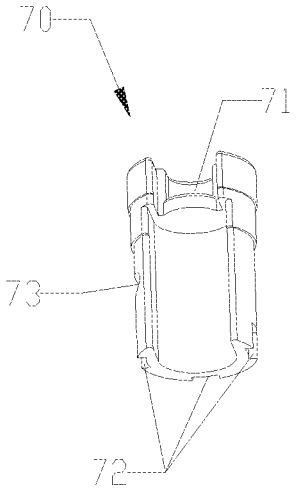
FIG. 7 is a perspective view of a fixed-cam forming part of the padlock.
Figure 8:
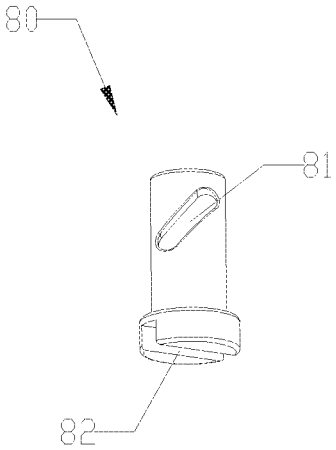
FIG. 8 is a perspective view of a cam forming part of the padlock.
Figure 9:
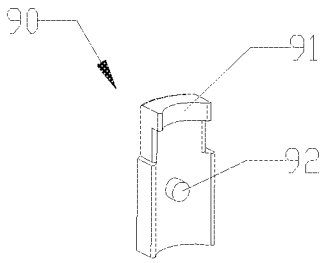
FIG. 9 is a perspective view of a blocking plate forming part of the padlock.
Figure 10:
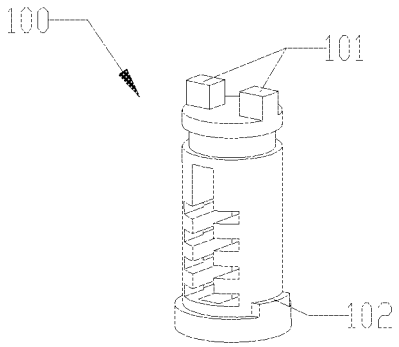
FIG. 10 is a perspective view of a cylinder forming part of the padlock.
Figure 11:
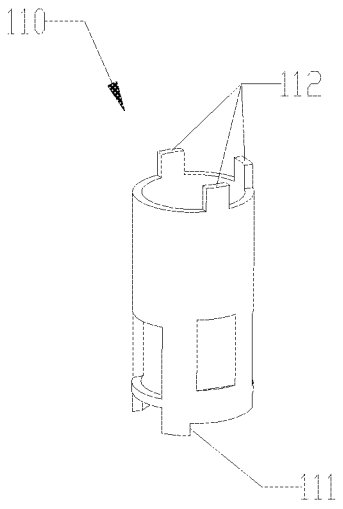
FIG. 11 is a perspective view of a cylinder-housing forming part of the padlock.
Figure 12:
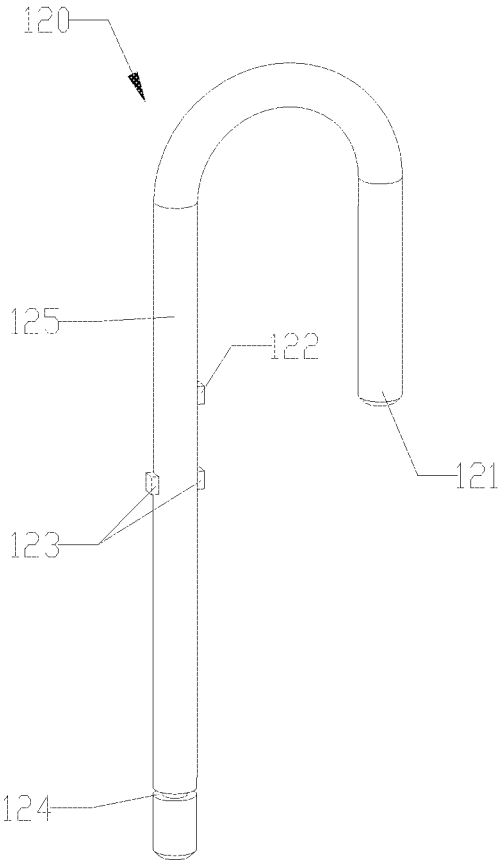
FIG. 12 is a perspective view of a shackle forming part of the padlock.
Figure 13A:
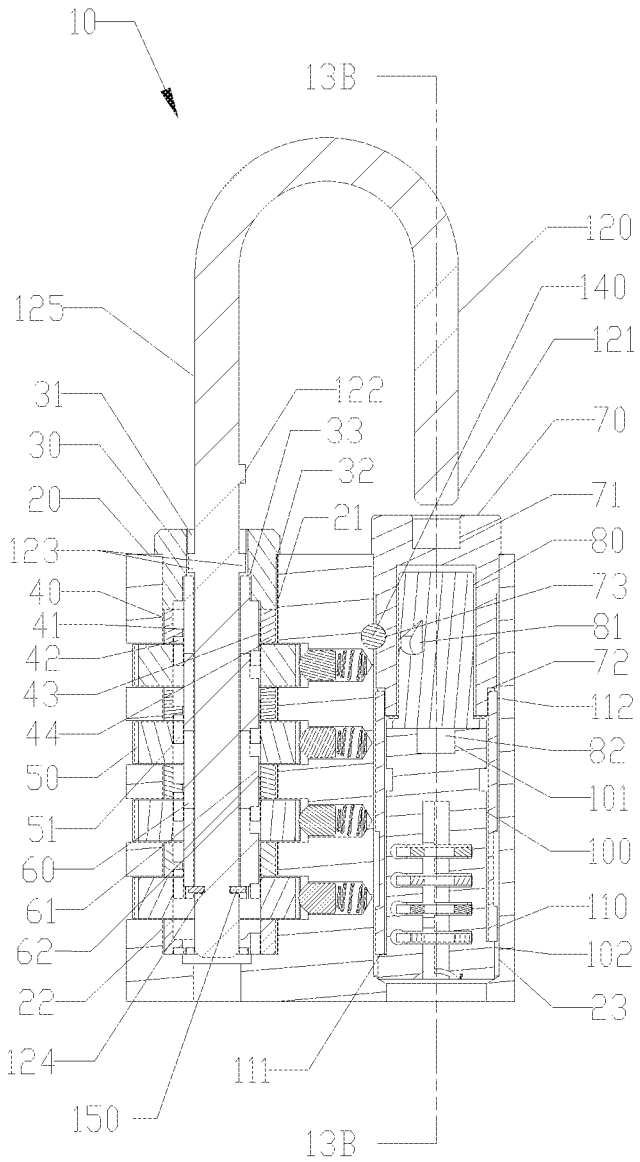
FIG. 13A is a cross-sectional view of the padlock showing the shackle in the unlock by combination mode.
Figure 13B:
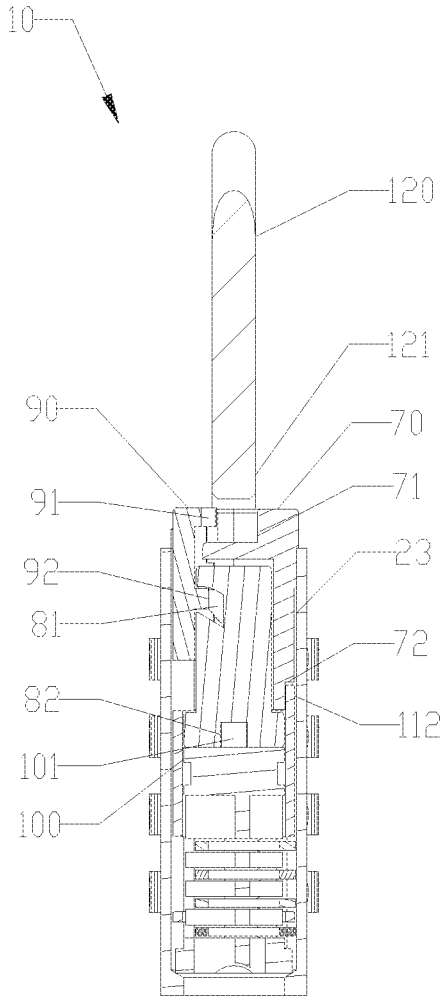
FIG. 13B is a cross-sectional view of the padlock taken along line 13B-13B of FIG. 13A.
Figure 14A:
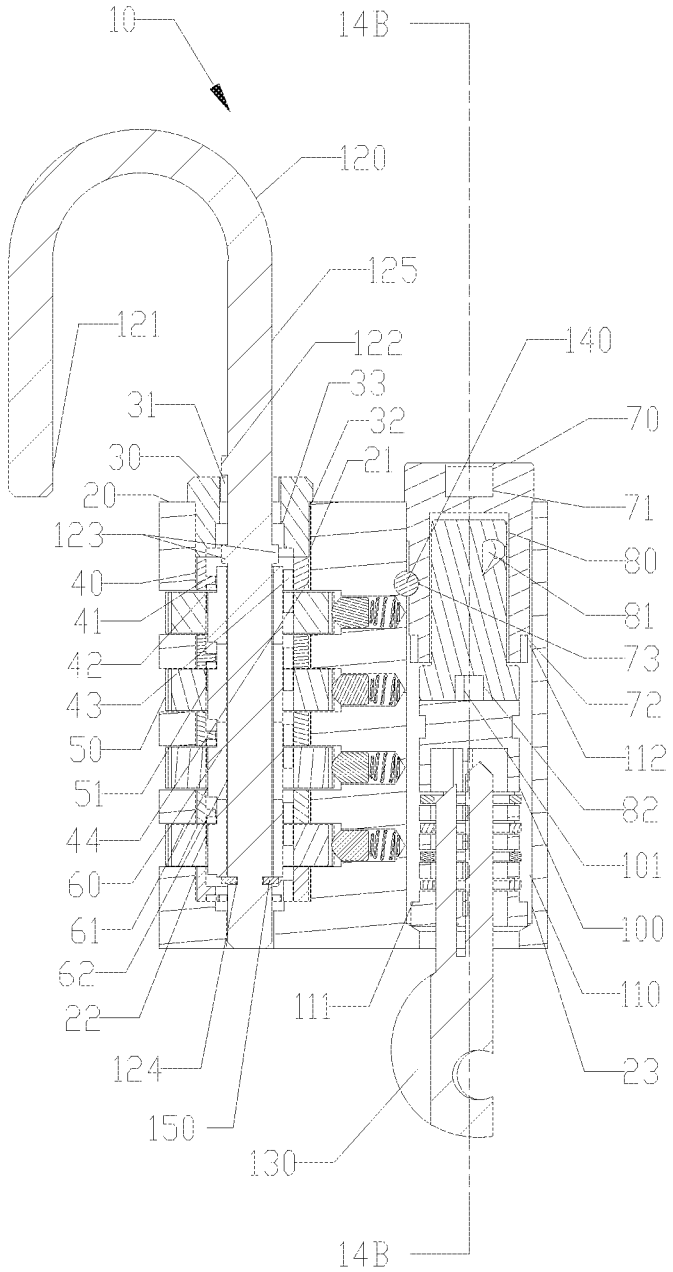
FIG. 14A is a cross-sectional view of the padlock in the unlock by key code mode showing the shackle rotated 180 degrees out of the locking-hole.
Figure 14B:
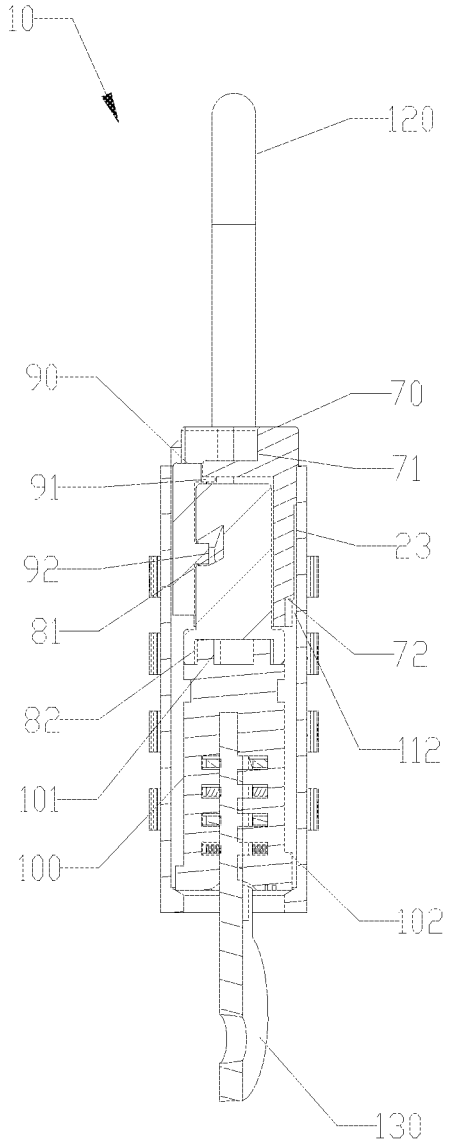
FIG. 14B is a cross-sectional view of the padlock taken along line 14B-14B of FIG. 14A.

Locked mode (FIG. 1A-12, FIG. 13A-13B, FIG. 16, and FIG. 22-23):

The padlock 10 contains a shackle 120 where the short-leg-shackle 121 is controlled by key mechanism 12. The key mechanism is positioned in a second bore (cylinder hole) 23 of body 20 (see FIG. 2). The long-leg-shackle 125 is positioned in a first bore 14 of body 20 (see FIG. 2) and is controlled by the combination mechanism. When the lock is in the locked mode, the shackle has no upward movement relative to body 20 so that the short-leg-shackle 121 remains in the locking-hole 71 of the fixed cam 70. Also, since as shown in this embodiment where no correct key 130 has been inserted into cylinder 100 of the key mechanism, the cam remains silent and the blocking plate has no movement which therefore blocks the short-leg-shackle 121 from opening by the key mechanism.

For the combination locked mode:

At least one dial 50 is not in the lock open combination and thus will not allow the lock to open. The teeth 51 of the dials 50 are engaged with the fin 61 of the clutches 60. In such a position, rotation of the dials 50 directly transfers to the clutches 60.

Meanwhile, the lock body 20 contains a series of plate holes 22 which are configured to receive the coupling plates 40. The fin-protrusion 44 of each coupling plate 40 engages with a fin-catcher 21 of the body 20. In this case, this will restrict the coupling plate from having any rotational movement. With the dials 50 being assembled in place, the coupling plate 40 is prevented from having any upward/downward movement. The top ring 30 also prevents the upper-most coupling plate 40 from moving upward away from the lock body since the top ring is press fitted so as to be permanently affixed into the lock body. The top ring 30 further comprises a direction-fin 32 that also engages with the upper-most fin-catcher 21 of the body 20 to make sure the assembly of the top ring is correct such that the angle of the assembled notches align with the desired angle. Hence, the coupling plate 40 is permanently affixed into the lock 10 without upward/downward or rotational movement.

The coupling-plate 40 contains equal number of false gates 42 and at least one opening-slot 43. In the embodiment shown, the dial has ten digits (N=10) and there are 9 false gates (N−1 false gates) and one opening-slot. With such an arrangement, an intruder would have to expend an extensive amount of time to pick the combination mechanism. The plate 40 also contains a decode-edge 41 wherein when the padlock 10 is opened by the key mechanism (described below), the short-leg 121 of the shackle 120 can rotate out of the locking-hole 71 of the fixed-cam 70. Then the user can push the shackle downward to decode the combination code. This feature is described further in the decode section.

The shackle 120 contains a clutch-protrusion 123 where the clutches 60 are stacked in between this reset-protrusion 122 to the neck 124. A C-clip 150 is inserted into the neck 124 to engage all clutches as permanently assembled in such a sandwiched position.

As the dials 50 rotate to a code where at least one of the fins 61 of one of the clutches 60 is not aligned with the opening-slot 43 of the plate 40, the shackle 120 cannot be pulled upward to let the short-leg 121 of the shackle move away from the locking-hole 71.

For the key lock:

In the lock mode, if a correct key 130 (i.e. a key that matches the key settings of cylinder 100) is not present, the cylinder 100 has no rotational movement. The fork 101 of the cylinder is engaged with the receiving-slot 82 of the cam 80 all the time. As the cylinder 100 has no movement, the cam 80 also has no movement. As the rotating-cam 80 is not moving then the sloping slot 81 does not move. Since the sloping slot 81 of the cam 80 is not moving then the pin 91 of the blocking plate 90 cannot be dragged vertically relative to the body. Since these elements do not move, then the blocking-edge 91 of the blocking plate 90 blocks the path of locking-hole 71 of the fixed-cam 70. The fixed-cam 70 also contains slots 72 which let the extended-tip 112 of the cylinder-housing 110 to be engaged together. The fixed-cam 70 further comprises a pin-hole 73 to receive a pin 140 which is affixed to the pin-hole 24 of the lock body 20. In such a position, the fixed-cam 70 has no rotational movement as the pin 140 prevents it from rotating and also the pin 140 controls the fixed-cam from being pulled away from the lock body 20. Also, the cylinder-housing 110 has no rotational movement due to the extended-tip 112 engaged with the slot 72 of the fixed-cam 70. In such a position, the cylinder 100 can move when there is a correct key-cut key 130 inserted and so that the wafers on the cylinder move away from the cylinder-housing so as to allow it to rotate. However, in the lock mode, there is no key 130 and therefore the cylinder does not rotate and the blocking-plate cannot move downward. The locking-hole 71 of the fixed-cam 70 is securely concealed.

Unlock by Combination (FIGS. 13A-14B and FIG. 17):

In the unlocked by combination mode, the fin 61 of each clutch 60 is fully aligned with the opening-slot 43 of the corresponding coupling-plate 40. This means that there is nothing to block the fin 61 of the clutch 60 from moving upward. The user can pull the shackle 120 upward and then the short-leg 121 of the shackle 120 is pulled away from the locking-hole 71 of the fixed-cam 70 and the short-leg 121. Once the shackle is pulled upward to the open position, the shackle 120 is free to turn. The shackle 120 can be pulled upward until the clutch 60 contacts the stop-end 33 of the top ring 30.

In the unlock by combination mode, the fin 61 of the clutch 60 is now engaged with the teeth 51 of the dial 50 and also engaged with the opening-slot 43 of the coupling-plate 40. This is a good feature since when the shackle is in the unlock by combination mode, the dials 50 cannot be turned to prevent accidental change of the combination code. The code will remain in the lock open combination code.

To re-lock the padlock, the user can push the shackle 120 downward such that the short-leg 121 falls into the locking-hole 71 of the fixed-cam 70. As the key lock mechanism is in the locked position then the blocking plate 90 remains in the locked position. This activates the blocking-edge to restrict shackle 120 from rotating to the open position. As the shackle 120 is in locked position, then the fin 61 of each clutch will disengage away from the opening-slot 43 of the corresponding coupling-plate 40. Meanwhile, the fin 61 of the clutch 60 still engages the teeth 51 of the corresponding dial 50. The user can then scramble the dials and the fin 61 of the clutch 60 will no longer align with the opening-slot 43 of the coupling-plate 40. In such a case, shackle 120 no longer can be pulled upward and therefore the lock is now in the lock mode (closed position).

Figure 18:
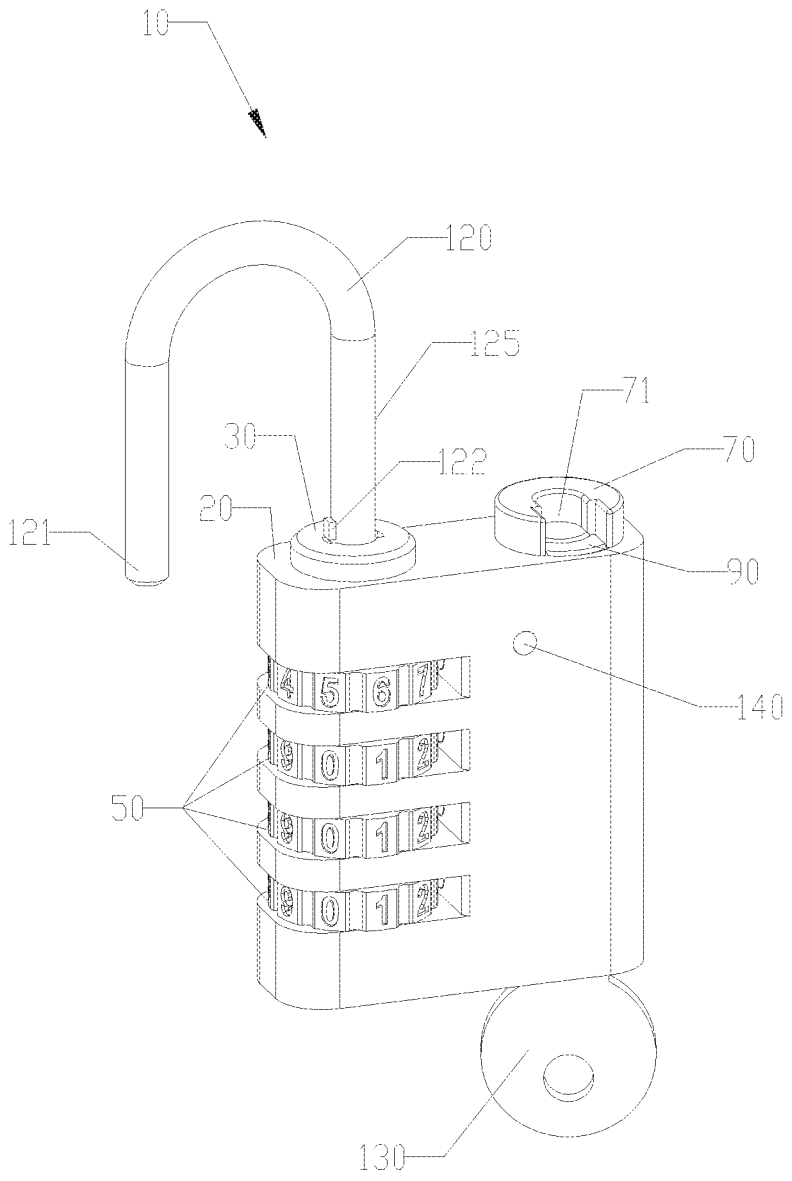
FIG. 18 is a perspective view of the padlock in the unlock by key mode showing the shackle rotated 180 degrees away from the locking-hole.

Unlock by Key Mode (FIGS. 14A-14B and FIG. 18):

Using the key mechanism to unlock the padlock, a correctly cut key 130 is inserted into cylinder 70. The wafer then retracts into the cylinder and does not extend out of the cylinder-housing 110 blocking the cylinder 100 from rotating.

The fork 101 of the cylinder 100 is engaged with the receiving-slot 82 of the cam 80 all the time. As the cylinder 100 rotates, the cam 80 turns in the same manner. The cylinder 100 rotating angle is controlled by the angle-control-edge 102 of the cylinder 100 and the stopping-edge 111 of the cylinder-housing 110. Since the cam 80 is rotating, the sloping slot 81 will move. Since the sloping slot 81 of the cam 80 is rotated then the pin 92 of the blocking plate 90 is dragged downward. As the blocking plate 90 moves downward, the blocking-edge 91 of the blocking-plate 90 will no longer be blocking the locking-hole 71 of the fixed-cam 70. The key user can now open the padlock by rotating the short-leg-shackle 121 out of the locking-hole 71 of the fixed-cam 70.

If the key user wants to relock the shackle 120, the user can rotate the short-leg-shackle 121 of the shackle to the locking-hole 71 of the fixed-cam 70. Then the user can rotate the cylinder 100 to the lock position by counter rotating the cylinder 100 so that the sloping slot 81 of the cam 80 drags the pin 92 of the blocking-plate 90 upward. As the blocking-plate 90 moves upward, then the blocking-edge 91 blocks the locking-hole 71 of the fixed-cam 70. The user can withdraw the key 130. Therefore, the short-leg 121 of the shackle 120 is in the locked position (locked mode).

Figure 15A:
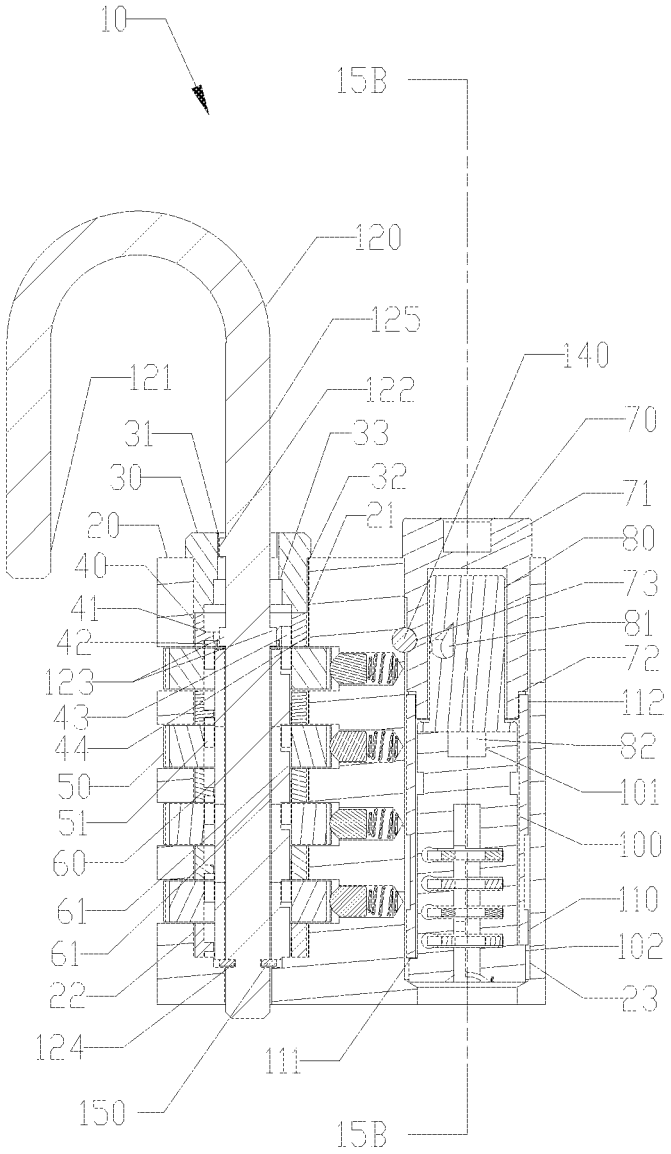
FIG. 15A is a cross-sectional view of the padlock with the long-leg of the shackle pushed downward so as to place the padlock in a reset mode.
Figure 15B:
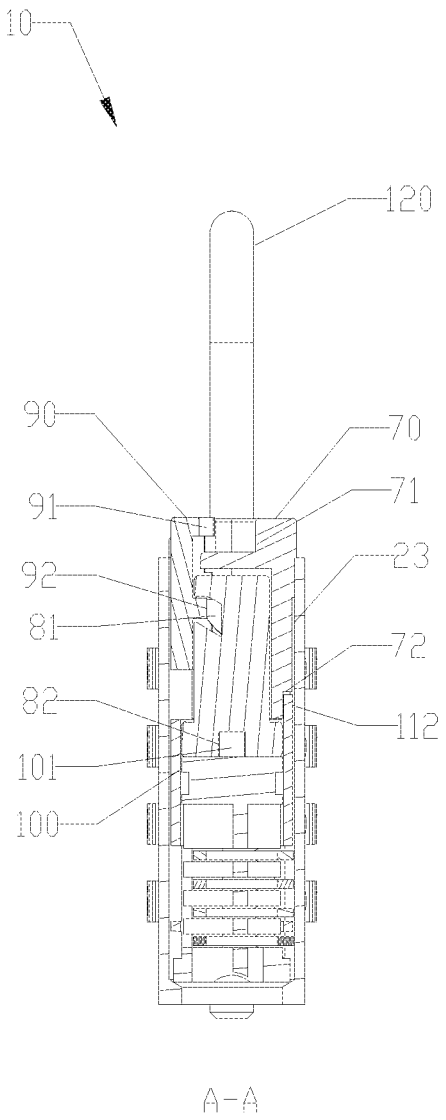
FIG. 15B is a cross-sectional view of the padlock taken along line 15B-15B of FIG. 15A.
Figure 16:
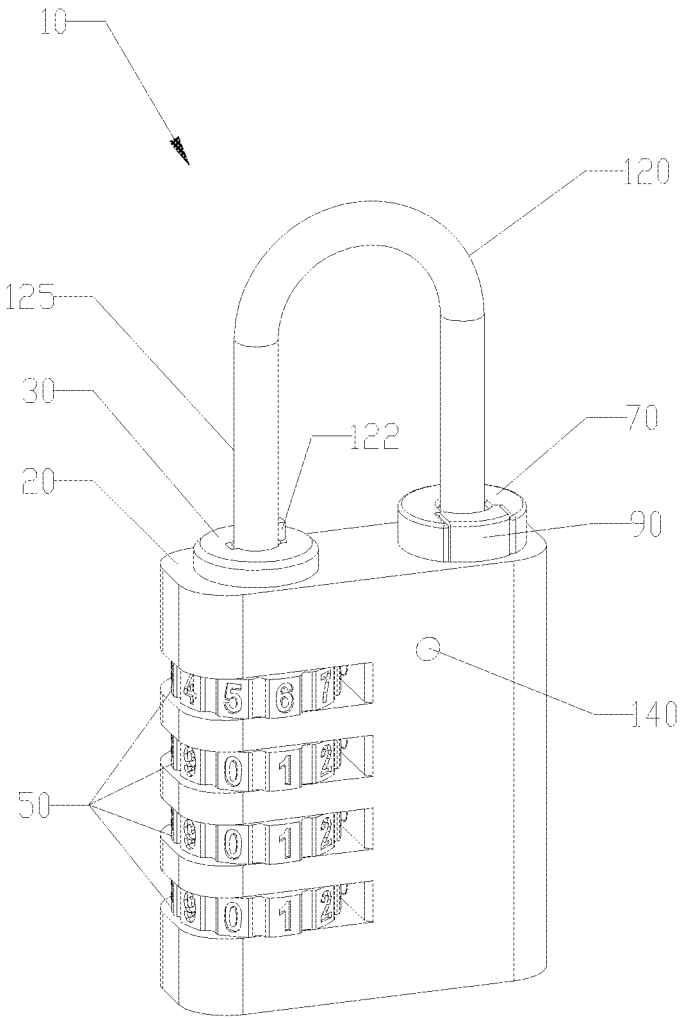
FIG. 16 is a perspective view of the padlock in the lock locked mode.
Figure 17:
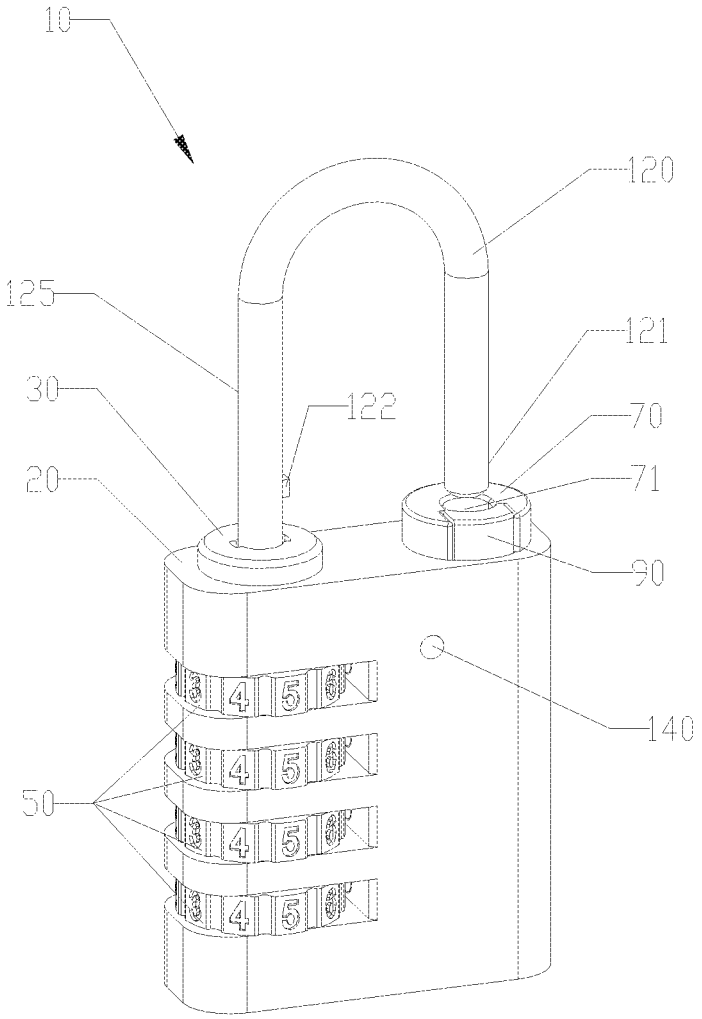
FIG. 17 is a perspective view of the padlock in the unlock by combination mode.
Figure 19:
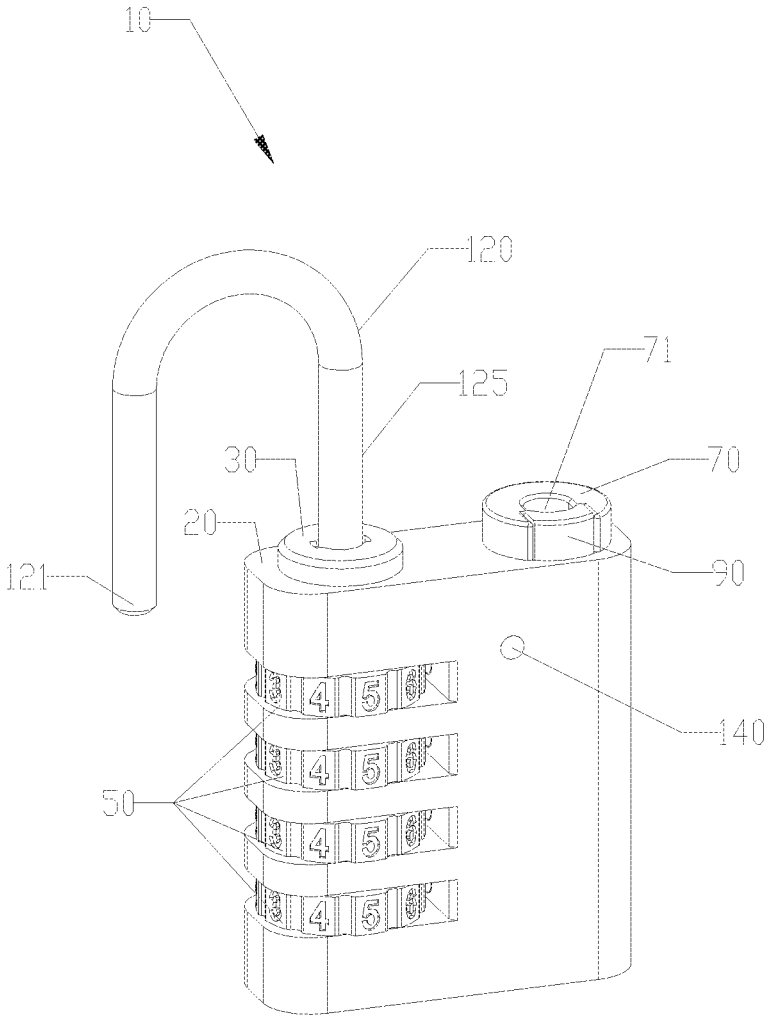
FIG. 19 is a perspective view of the padlock in the reset mode with the shackle pushed downward so as to place the padlock in the reset mode.

Reset mode (FIGS. 15A-15B and FIG. 19):

In the reset mode, the user must open the lock via the unlock by combination mode (dials set to the unlock combination). As the shackle 120 is being pulled upward, the user can turn it 180 degree such that the reset-protrusion 122 will align with the notches 31 of the top ring 30 such that shackle can be pushed all the way downward to the reset position. In such a position, the fin 61 of each clutch 60 will disengage the teeth 51 of the corresponding dial 50. The fin 61 of the clutch will engage with the opening-slot 43 of the corresponding coupling-plate 40. In this position, the user turns the dials to a new code, and the clutches will remain silent without being turned.

After setting, the user can pull the shackle 120 upward such that the fin 61 of each clutch 60 will engage back with the teeth 51 of the corresponding dial 50. The fin 61 will then disengage from the opening-slot 43 of the coupling-plate 40.

To lock, the user can the place the short-leg 121 of the shackle 120 into the locking-hole 71 of the fixed-70 and scramble the dials such that the fin 61 of each clutch 60 does not align with the opening-slot 43 of the corresponding coupling-plate 40.

Figure 20A:
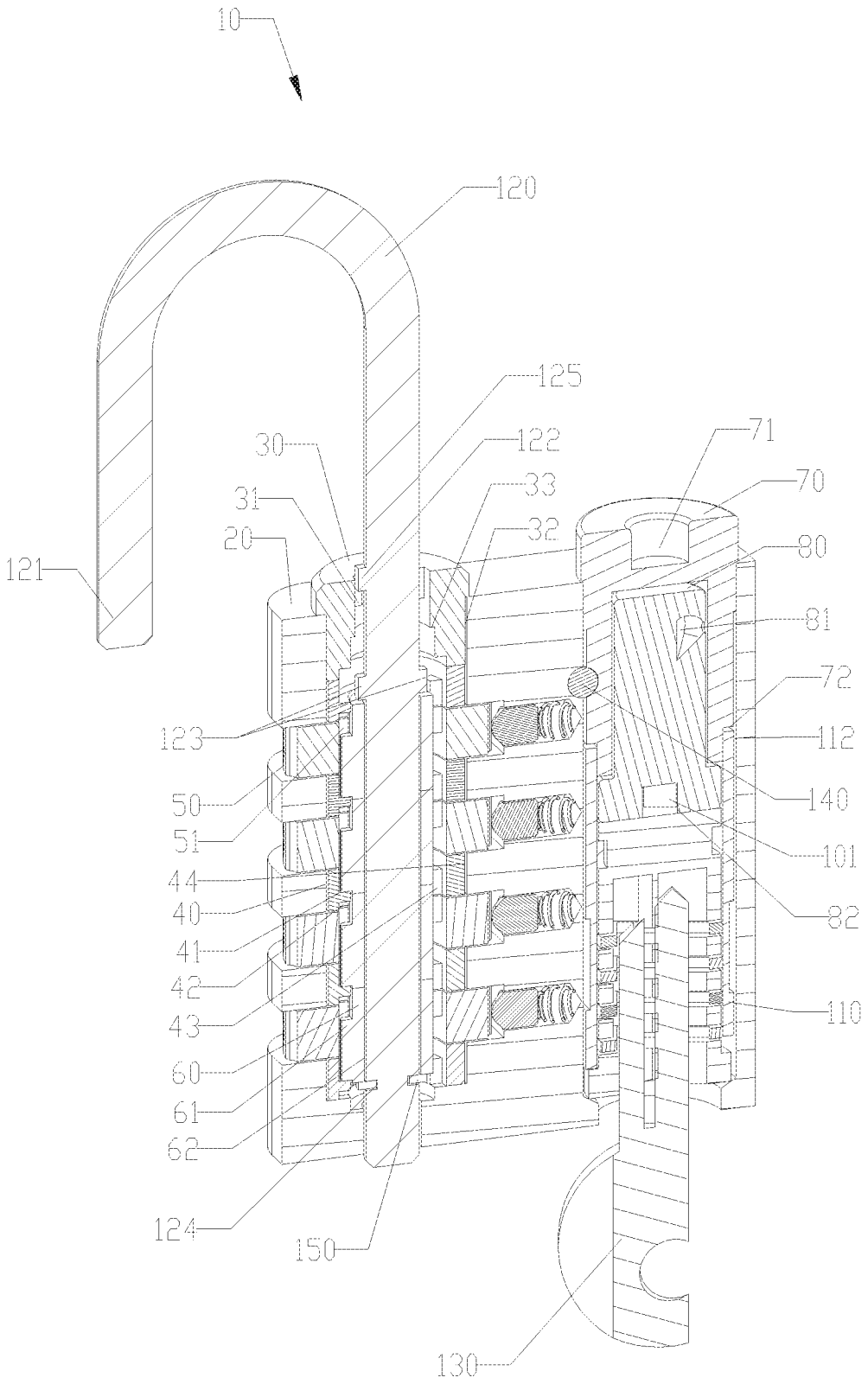
FIG. 20A is a cross-sectional perspective view of the padlock when placed in the decode mode by pushing down the long-leg of the shackle as shown.
Figure 20B:
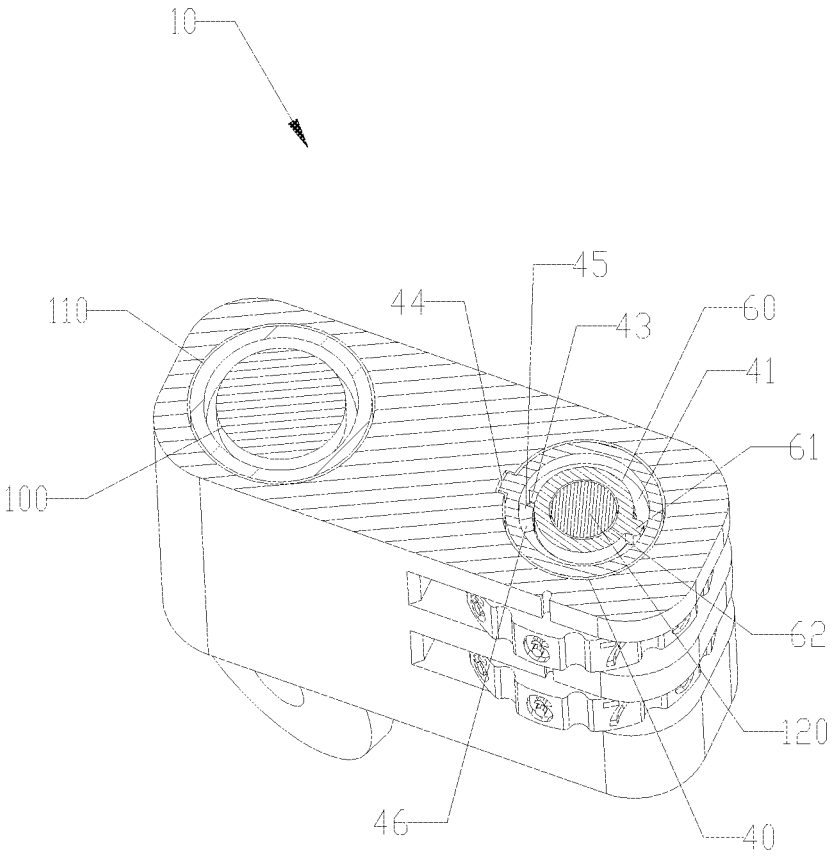
FIG. 20B is a cross-sectional perspective view of the padlock showing details of the padlock when in the decode mode.
Figure 21A:
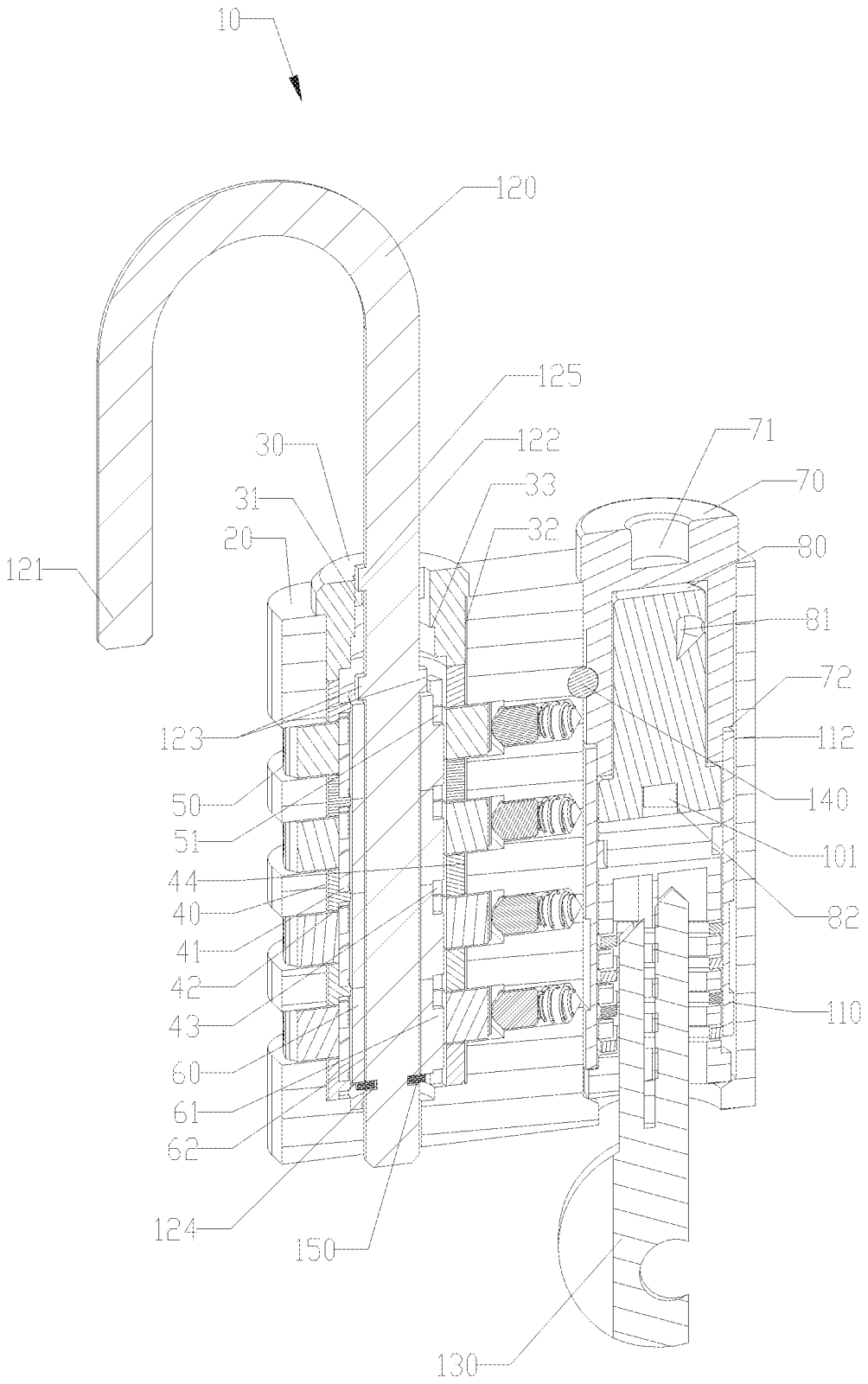
FIG. 21A is a cross-sectional perspective view of the padlock when in the decode mode.
Figure 21B:
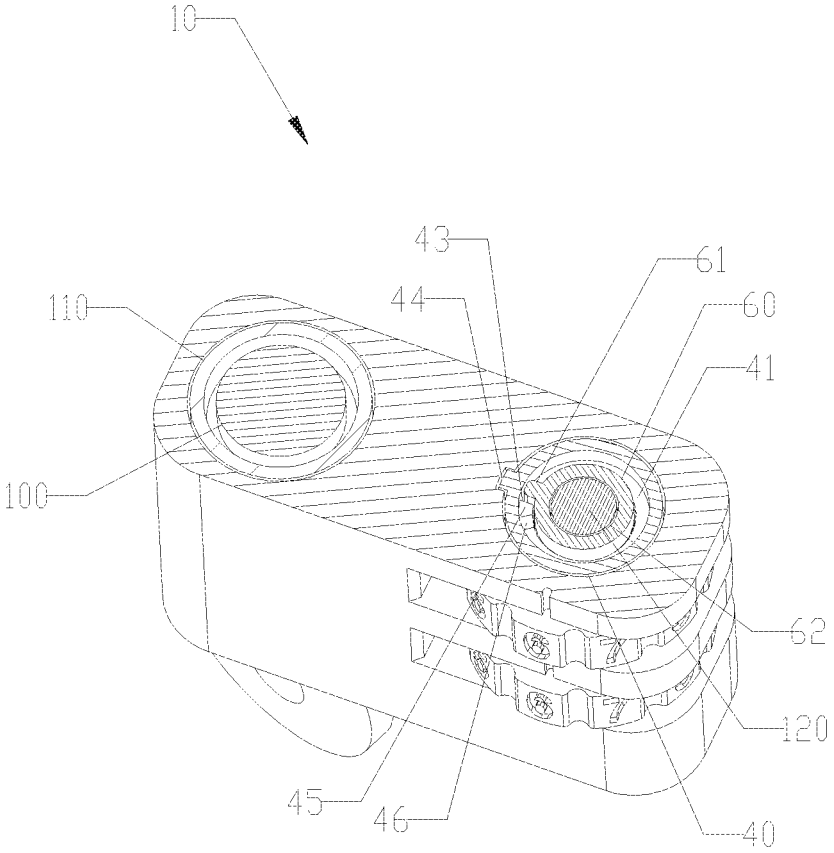
FIG. 21B is a cross-sectional perspective view of the padlock when in the decode mode.
Figure 22:
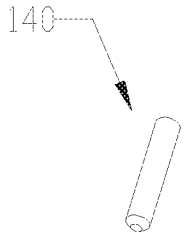
FIG. 22 is perspective view of a pin forming part of the padlock.
Figure 23:
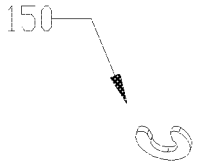
FIG. 23 is a perspective view of a C-clip forming part of the padlock.

Decode mode (FIG. 20A,20B,21A,21B):

FIG. 20A-20B shows the padlock in the decode mode where the fin 61 of each clutch 60 has not contacted the decode wall 45 of the corresponding coupling-plate 40. FIG. 21A-21B shows the padlock in decode mode with the fin 61 of each clutch contacting the decode wall 45.

In the decode mode, the user must open the lock via the unlock by key mode (using a correctly cut key). As the short-leg-shackle 121 is rotated out of the locking-hole 71 of the fixed-cam 70, the user can rotate the shackle 180 degree such that the reset-protrusion 122 aligns with the notches 31 of the top ring 30. Then, the user can press the shackle downward to the decode mode (similar action to the reset mode, but the fin 61 of the clutch 60 will not disengage away from the teeth 51 of the dial 50 in the decode mode since the travel distance to the decode mode is shorter than the distance to the reset mode). As the shackle is pushed downward, the fin 61 of each clutch 60 contacts the decode-edge 41 of the corresponding coupling-plate 40. The user can then turn dials 50 and the clutches will turn in the same manner. The user can rotate the dials in the correct direction (in this case it is counter-clockwise) so that the fin 61 of each clutch 60 contacts the corresponding decode wall 45 of the coupling-plate 40. The decode wall 45 will then catch fin 61 to stop the corresponding clutch 60 and dial 50 from rotating. The decode wall 45 is in the same position as the opening-slots 43 of the coupling-plate 40. This means that as the dials stop rotating, the digits will align to its preset code (unlock code).

In addition, as the shackle 120 is pushed downward, the fin 61 of each clutch 60 travels one below the corresponding coupling-plate 40. This means that if the padlock contains 4 dials then it requires 5 coupling-plates for decode function usage. Since all of the positions of the coupling-plate and angle are the same, when the fins 61 of the clutches contact the decode wall 45 of the below coupling-plate 40, it will cause the decoding of the dials 50 above the code.

There is a wall slope 46 in the coupling-plate 40. In the decode mode, if the user rotates the dial 50 in the wrong direction (in this case it is clockwise) then the wall slope 46 will cause the fin 61 to slide higher which then lets the shackle travel upward so that the user will not be able to decode, since the fin 61 will not be able to contact the decode wall 45 of the coupling plate 40. This requires the user to decode by rotating the dials into only one direction for actual decode.

Once all fins 61 of the clutches 60 contact in the decode wall 45, then the fins 61 also align with the opening-slot 43. The user can pull the shackle 120 upward such that the fins 61 will engage back to the opening-slot 43 of the coupling-plate 40. The user may also push the shackle further downward in order to reset the combination code.

Reference numbers for this application are as below:

10 Padlock.

12 Key mechanism

14 First bore

20 Body. 21 Fin-catcher. 22 plate-hole. 23 Second bore (cylinder hole). 24 pin-hole.

30 Top Ring. 31 Notches. 32 Direction-Fin. 33 Stop-end.

40 Coupling-Plate. 41 Decode-edge. 42 False Gates. 43 Opening-slot. 44 Fin-Protrusion. 45 Decode wall. 46 Wall slope.

50 Dial. 51 Teeth.

60 Clutch. 61 fin. 62 Holes.

70 Fixed-Cam. 71 Locking-Hole. 72 Slot. 73 Pin-hole.

80 Cam. 81 Sloping slot. 82 Receiving-slot.

90 Blocking-Plate. 91 Blocking-Edge. 92 Pins.

100 Cylinder. 101 Fork. 102 Angle-control-edge.

110 Cylinder-housing. 111 Stopping-Edge. 112 Extended-tip.

120 Shackle. 121 Short-leg-shackle. 122 Reset-protrusion. 123 Clutch-protrusion. 124 Neck. 125 Long-leg-shackle.

130 Key.

140 Pin.

150 C-clip.

Components that are not numbered but shown in the drawing:

1. Wafers on the Cylinder
2. Wafer's spring on the cylinder.
3. Ratchet Spring Plate using on the dials.
4. Ratchet Pin using on the dials.

What is claimed is:

1. A padlock comprising:

a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening arranged for receipt of a short-leg of the shackle in a top side of the body;

a plurality of coupling plates, each comprising a fin-protrusion, an opening slot and a plurality of faulty notches;

a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body;

a plurality of dials, each dial having a plurality of indicia for forming an indicia sequence, each dial placed within one of a plurality of dial slots formed adjacent said plate holes; and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, and wherein the fin of each of the clutches is arranged to contact either the faulty notches or the opening slot when said clutch is caused to rotate together with the associated dial.

2. The padlock according to claim 1, wherein each dial has N indicia and each coupling plate has N−1 faulty notches, with N being an integer greater than one.

3. The padlock according to claim 1, wherein each of the plurality of clutches is associated with one of the plurality of coupling plates, and when the padlock is in the unlock by combination mode, the fin of each of the plurality of clutches is aligned with the opening slot in the associated coupling plate, allowing the longitudinal movement of the long-leg together with the plurality of clutches.

4. The padlock according to claim 3, wherein when the padlock is in the unlock by combination mode, the fin of each of the plurality of clutches is caused to move into the opening slot of the associated connecting plate by the longitudinal movement of the long-leg, so that the dials cannot turn and thereby preventing accidental change of the lock-open combination code.

5. The padlock according to claim 4, comprising a top ring positioned in a top of the first longitudinal bore so as to prevent an uppermost coupling plate of said plurality of coupling plates from rotating relative to the first longitudinal bore.

6. The padlock according to claim 5, wherein the top ring includes a direction-fin that engages one of the fin-catchers.

7. The padlock according to claim 6, wherein when the padlock is in the unlock by combination mode, the shackle can be rotated 180 degrees away from the locking-hole to allow the long-leg of the shackle to be moved downward relative to the top ring so that the fin of each clutch disengages from the teeth of the corresponding dial, thereby allowing turning of the dials to enter a new lock-open combination code constituting a reset mode.

8. The padlock according to claim 7, having an unlock by key mode, said padlock further comprising:

a blocking-plate that controls movement of a moveable blocking-edge, and wherein the key mechanism is configured to control said blocking-edge so as to move said blocking-edge away from the opening in the fixed-cam so as to allow rotation of the short shackle away from the locking-hole when a correct key is inserted and rotated in said key mechanism.

9. The padlock according to claim 8, wherein the key mechanism includes a cylinder with a cylinder housing, and wherein the fixed-cam comprises a slot to receive an extended-tip of the cylinder housing, wherein the fixed-cam is permanently affixed to the body so as to prevent the fixed-cam and cylinder housing from rotational or longitudinal movement relative to the body when the padlock is not in the unlock by key mode.

10. The padlock according to claim 9, wherein the blocking-plate comprises a pin, and the cylinder is configured to receive the correct key for rotating the cylinder in said key mechanism, the padlock further comprising a rotating cam engaged with the cylinder for rotation together, the rotating cam comprising a sloping slot slidably engaged with the pin of the blocking-plate, wherein when the cylinder is rotated, the blocking edge of the blocking-plate is caused to move away from the opening of the blocking hole on the fixed cam.

11. The padlock according to claim 1, wherein each clutch further comprises more than one fin and each coupling plate has more than one opening slot, so that the unlock by combination code only occurs when the fins correctly align with the open slots.

12. A padlock comprising:

a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening arranged for receipt of a short-leg of the shackle in a top side of the body;

a plurality of coupling plates, each comprising a fin-protrusion and an opening slot;

a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body;

a plurality of dials, each dial having a plurality of indicia for forming an indicia sequence, each dial placed within one of a plurality of dial slots formed adjacent said plate holes; and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, and each of the coupling plates further comprises a decode edge and a decode wall formed thereon, the decode wall having a first wall side adjacent to the opening slot and a second wall side having a wall slope, said padlock having an unlock by key mode to allow the short-leg of the shackle to rotate 180 degrees relative to the locking-hole so as to allow the long-leg of the shackle to move downward relative to the top side of the body together with the clutches such that the fin of at least some of the clutches is in contact to the decode edge of an adjacent one of the coupling plates, and wherein when the rotational movement of each clutch is made in a first movement direction, the rotational movement in the first movement direction is caused to stop when the fin of said clutch contacts the first wall side of the decode wall as the fin aligns with the adjacent opening slot, thereby allowing the lock-open combination code to be read, and when the rotational movement of each clutch is made in a direction opposite to the first movement direction, said long-leg of the shackle is caused to move upward relative to the top side of the body when the fin of said clutch is caused to move upward by the wall slope, preventing the fin of said clutch from aligning with the adjacent opening slot.

13. The padlock according to claim 12, wherein each coupling plate further comprises a plurality of faulty notches, and the fin of each of the clutches is arranged to contact either the faulty notches or the opening slot when said clutch is caused to rotate together with the associated dial when the indicia sequence of the dials is different from a lock-open combination code, and wherein each of the decode edge comprises a first edge side for forming the faulty notches and an opposing second side for forming the decode wall having the wall slope.

14. A method of decoding a lock-open combination code in a padlock, the padlock comprising:

a body having a first longitudinal bore for receipt of a long-leg of a shackle and a second longitudinal bore for receipt of a fixed-cam and a key mechanism, the fixed-cam having a locking-hole with an opening blocked by a moveable blocking-edge, the opening for receipt of a short-leg of the shackle in a top side of the body;

a plurality of coupling plates, each comprising a fin-protrusion and an opening slot;

a plurality of fin-catchers formed in the first longitudinal bore, each fin-protrusion configured to be placed within one of the fin-catchers so as to prevent the coupling plate from rotating relative to the body when the coupling plate is placed within one of a plurality of plate holes formed in said body;

a plurality of dials, each dial having a plurality of indicia for forming an indicia sequence, each dial placed within one of a plurality of dial slots formed adjacent said plate holes; and a plurality of clutches, each clutch corresponding to an adjacent one of the plurality of dials to control longitudinal movement of said long-leg of the shackle and thereby preventing the short-leg of the shackle from longitudinal movement away from the locking hole when the indicia sequence of the dials is different from a lock-open combination code, wherein the dials are configured so as to control rotational movement of the plurality of clutches to allow said longitudinal movement of said long-leg when the indicia sequence matches the lock-open combination code constituting an unlock by combination mode, wherein each of the dials has a plurality of teeth and each of the clutches has a fin engageable with one of the teeth of the associated one of the plurality of dials for rotational movement together, said method comprising:

providing on each of the coupling plates a decode edge and a decode wall formed thereon, the decode wall having a first wall side adjacent to the opening slot and a second wall side having a wall slope, said padlock having an unlock by key mode to allow the short leg of the shackle to rotate 180 degrees relative to the locking hole so as to allow the long leg of the shackle to move downward relative to the top side of the body together with the clutches such that the fin of at least some of the clutches is arranged to contact the decode edge of an adjacent one of the coupling plates, and wherein when the rotational movement of each clutch is made in a first movement direction, the rotational movement in the first movement direction is caused to stop when the fin of said clutch contacts the first wall side of the decode wall as the fin aligns with the adjacent opening slot, thereby allowing the lock-open combination code to be read, and when the rotational movement of each clutch is made in a direction opposite to the first movement direction, said long leg of the shackle is caused to move upward relative to the top side of the body when the fin of said clutch is caused to move upward by the wall slope, preventing the fin of said clutch from aligning with the adjacent opening slot.

* * * * *